United States Patent [19]

Kelley

[11] Patent Number: 4,634,012

[45] Date of Patent: Jan. 6, 1987

[54] SAFETY BOTTLE CLOSURE HAVING A TIME INDICATOR

[76] Inventor: John Kelley, Rte. 4, Box 146-B, Lexington, Tenn. 38351

[21] Appl. No.: 784,542

[22] Filed: Oct. 4, 1985

[51] Int. Cl.[4] ..... B65D 55/02; B65D 85/56; A61J 1/00

[52] U.S. Cl. ..... 215/203; 215/220; 116/308

[58] Field of Search ..... 215/203, 219, 220; 206/534; 116/308

[56] References Cited

U.S. PATENT DOCUMENTS 4,489,834 12/1984 Thackrey ..... 206/534
4,555,036 11/1985 Bekkers et al. ..... 215/220

*Primary Examiner*—George T. Hall
*Attorney, Agent, or Firm*—Pitts and Brittian

[57] ABSTRACT

A closure for bottles having twist-type closure provision. The closure includes an inner member with a disk-like portion and a depending peripheral lip having an interior adapted to match the particular closure provision of the bottle. A neck projecting from the disk portion terminates in a closed flange having a slightly greater diameter than the neck. An outer member, rotatable with respect to the inner member, has a disk-like portion and a depending peripheral lip equally spaced from that of the inner member and has a central opening of a diameter intermediate that of the neck and the flange to permit snapping the flange through the opening to assemble the closure. A spring between the disk portions of the members normally maintain these portions separated but allows movement toward each other when pressure is applied to the outer member. Cooperating opening tabs between the members, when aligned and engaged by pressure upon the outer member, permit the outer member and the inner member to be turned counterclockwise in unison to effect removal of the closure from the bottle. Arrow indicia on the top surfaces of the flange and the outer member indicate the proper alignment of the opening tabs. Cooperating closure tabs carried by the members effect the clockwise turning of the components is unison to tighten the closure. Optionally, numerals are equally spaced about the opening in the outer member to provide information as to the time of the next dosage of a medicine, for example.

15 Claims, 12 Drawing Figures

SAFETY BOTTLE CLOSURE HAVING A TIME INDICATOR

DESCRIPTION

1. Technical Field

This invention relates generally to closures for bottles and similar objects having an opening provided with external threads or other twist type provision, and more particularly to closures for medicine bottles and the like for indicating the time for the next dosage, the closure being child-proof.

2. Background Art

Considerable background for this invention is set forth in my U.S. Pat. No. 4,501,370, issued on Feb. 26, 1985. Briefly, it is a common problem with many persons, especially the elderly, to forget the time to take the next dosage of a medicine. The prescription may indicate "every four hours", but often the time of the last dosage cannot be remembered. Thus, it is desirable to indicate the next dosage time when a dose is taken. While there are devices for this indication, most are difficult to manufacture. Yet another problem with many closures for medicine bottles is the difficulty of opening them when the design is such as to make the bottle "child-proof". In fact, many of such closures are also referred to as being "adult-proof."

The closure of my above-identified patent was an improvement upon what was available. It has certain disadvantages, however, including the necessity of squeezing the closure to remove the same from a bottle (the child-proof feature) or to replace the closure. Some persons afflicted with arthritis have difficulty in this operation because of the soreness in the fingers or wrists, for example.

Accordingly, it is a primary object of the present invention to provide a bottle closure that can be used for medicine bottles which provides a "child-proof" feature that does not require a squeezing action for either opening or closing the bottle.

It is another object of the present invention to couple the improved child proof construction with an indicator for giving information as to the time of the next dosage.

Other objects and advantages of the present invention will become apparent upon a consideration of the drawings and the detailed description that follows.

SUMMARY OF THE INVENTION

In accordance with the present invention, there is provided a two-piece closure for medicine bottles and the like having a top or neck provided with external threads or other twist-type surface. An inner member is provided with internal threads or other surface to mate with that of the bottle for sealing the bottle. The second piece or outer member, which generally surrounds the inner member, has a central aperture to receive an upstanding dial-like portion of the inner member, with a snap fit between the pieces at this aperture. Spring-like lift tabs are positioned between top flat surfaces of both the inner member and the outer member to urge them apart but to yield under pressure applied to the top of the outer member. Both the top surface of the dial-like portion of the inner member and the top surface of the outer member carry arrows or like signs that, when aligned, permit the closure to be removed if downward pressure is applied to the outer member. This is achieved through the use of a tab carried by one of the members that is inserted between two tabs in the other member when this pressure is applied. Thus, both of the members can be turned in unison counter-clockwise to remove the closure. A second set of tabs are provided upon the members that are engaged whenever the closure is turned in a clockwise direction, thus assuring tightening of the closure upon the bottle. In one embodiment, the top surface of the outer member also carries numbers (which may be raised) indicating the hours so that a specific time of day can be selected for the next dosage.

DETAILED DESCRIPTION OF THE INVENTION

Figure 1:
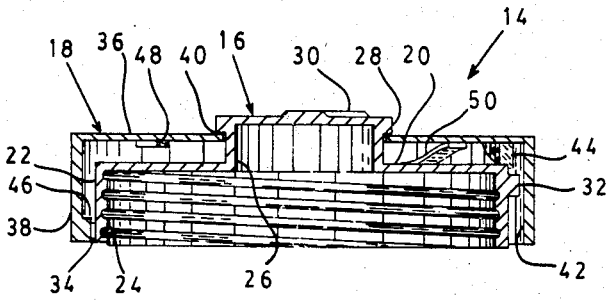
FIG. 1 is a cross-sectional view of one embodiment of the present invention taken at 1—1 of FIGS. 2 and 5 when the components shown in those figures are combined.

Referring now to FIG. 1, shown therein at 14 is one embodiment of the present invention. It is fabricated of two components: an inner member 16 and an outer member 18. The inner member 16 is generally cupped shaped, with a flat top or disk portion 20 and a depending lip 22. The interior surface of the lip 22 is provided with threads 24 to mate with threads on a bottle (not shown) that is to be closed. It will be understood that if the bottle has another type of twist type closure provision, the interior surface of the lip 22 will have a corresponding configuration. A neck portion 26 is upstanding from the disk portion 20, and terminates in a closed flange-like portion 28 that has a diameter slightly greater than that of the neck 26. This flange 28 optionally carries a raised arrow 30 (see FIG. 2). The exterior surface of the lip 22 carries opening tabs 32 and a closing tab 34 that are more clearly seen in FIG. 2.

The outer member 18 is also generally cupped shaped, with a flat disk-like upper portion 36 and a depending lip 38. The interior of the outer member 18 is dimensioned to encompass the exterior of the inner member 16, and the upper portion 36 is provided with a central aperture 40 to closely embrace the neck 26 of the inner member 16. The interior 42 of the lip portion 38 is provided, near the upper portion, with an opening tab 44; and, near the lower edge, with a closing tab 46. These are illustrated more clearly in FIG. 5. Interposed between the flat surfaces of the inner member 16 and the outer member 18, as shown, are a pair of spring-like members or lift tabs 48, 50, that urge these surfaces apart but allow them to be pressed toward each other.

Figure 2:
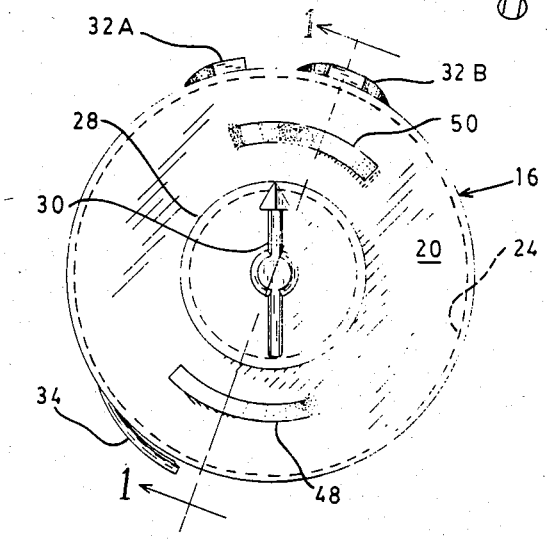
FIG. 2 is a top view of the inner member of the embodiment of FIG. 1 showing the indicator arrow, the lift tabs and the opening and closing tabs carried by that portion of the present invention.

A top view of the inner member 16 is shown in FIG. 2. This view illustrates the arrow 30 on the flange 28 as well as the opening tabs 32A, 32B, and the closing tab 34. It can be seen, for example, that the closing tab 34 is cantilevered from the outer surface of the lip 22 in a direction whereby a cooperating tab on the outer member engages the same so as to cause tightening the closure upon a bottle. This tab 34, however, has sufficient flexibility such that the cooperating tab on the outer member can pass by when the outer member is turned in a counter-closkwise direction. Furthermore, the lift tabs 48, 50 are shown as being attached at one end each to the flat disk portion 20. These lift tabs 48, 50 are essentially cantilevered spring units.

Figure 3:
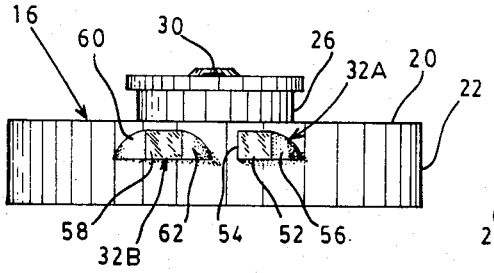
FIG. 3 is a side view, taken from the rear side, of the inner member of FIG. 2 showing an elevation of the opening tabs carried by that inner member.

The opening tabs 32 associated with the inner member 16 are more clearly illustrated in FIG. 3. As also shown in FIG. 2, there are two portions 32A and 32B. Portion 32A has a raised portion 52 of uniform height with a flat face 54 and an angled face 56. (The purpose of these faces, and those of tab 32B will be described in connection with FIG. 8). Tab portion 32B has a central portion 58 of uniform height and angled faces 60, 62. By referring to both FIGS. 2 and 3, it can be seen that all of the angled faces of both the opening tab units 32A and 32B slope in two directions in this embodiment.

Figure 4:
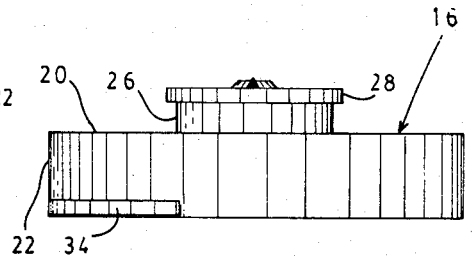
FIG. 4 is a side view, taken from the front side, of the inner member of FIG. 2 showing an elevation of the closing tab carried by that inner member.

FIG. 4 is another side view of the inner member 16. More clearly seen therein is the cantilevered closing tab 34 located at substantially the lower edge of the lip 22. Also, shown therein more clearly is the length of the neck 26 between the disk portion 20 of the inner member 16 and the flange 28. This length of the neck is selected to accommodate the thickness of the disk portion of the outer member 18 plus the movement necessary to engage the various components of the opening tabs. Typically the distance of this movement is about 1/16 inch.

Figure 5:
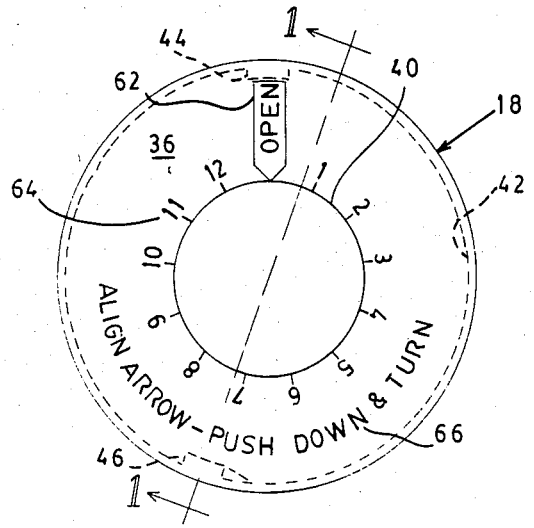
FIG. 5 is a top view of the outer member of the embodiment of FIG. 1 showing the indicator arrow, the time numerals, and the opening tab and the closing tab carried by that portion of the present invention.

The top surface 36 of the outer member 18 is shown in FIG. 5. The central aperture 40 can be seen; this aperture accepts the neck of the inner member 16 as shown in FIG. 1. Also, the opening tab 44 and the closing tab 46 are indicated so as to show their relative positions to the cooperating tabs of the inner member 16. This top is provided with an arrow 64 and, optionally, the word "OPEN" within the arrow. Around the periphery of the aperture 40 are twelve positions other than at the arrow; these optionally can have numerals 64 to indicate the hours for dosage. The numerals can, optionally, be raised (e.g., embossed) above the surface 36. In order to give instructions to a user of the bottle, brief instructions 66 can be imprinted on the top; these also optionally can be embossed on the surface. When the outer member is pushed down, as indicated by the instructions, counter-clockwise turning will open the bottle and clockwise turning will tighten the closure on the bottle. When no pressure is applied, counter-clockwise rotation will not effect any rotation of the inner member and clockwise rotation will tighten the closure.

Figure 6:
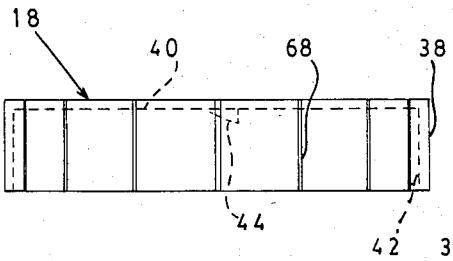
FIG. 6 is a side view, taken from the rear side, of the outer member of FIG. 5 showing the elevation of the opening tab carried thereby.
Figure 7:
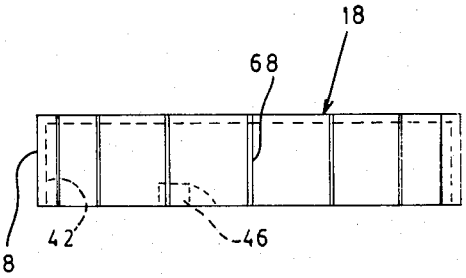
FIG. 7 is a side view taken from the front side of the outer member of FIG. 5 showing the elevation of the closing tab carried by that outer member.

Side or edge views of the outer member 18 are shown in FIGS. 6 and 7. In FIG. 6, the elevation of the opening tab 44 on the inside is shown, and in FIG. 7 is shown the closing tab 46. The external surface of the lip portion 38 can, optionally, be provided with ridges 68 to facilitate grasp during the turning of the outer member 18.

Figure 8:
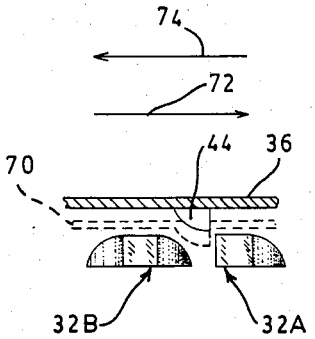
FIG. 8 is a schematic drawing illustrating the operation of the opening tabs of the present invention.

FIG. 8 schematically illustrates the operation of the opening tabs of the present invention. When no pressure is applied to the top surface 36 of outer member 18, the opening tab 44 attached thereto is in the position indicated by solid lines. It can be seen that if the outer member is turned in either direction, there is no interaction between the tab 44 and the opening tabs 32A and 32B on the inner member 16. However, when pressure is applied, movement to positon 70 occurs whereby, in dashed lines, it can be seen that the tab 44 is placed between tab 32A and tab 32B with flat surfaces in contact. Then when the outer member 18 is turned in the direction indicated by the arrow 72, this direction being counter-clockwise, the inner member will also be turned and thus the bottle will be opened. However, if the outer member 18 is turned in the direction indicated by the arrow 74, which is clockwise, the tab 44 will slip over tab 32B and the inner member 16 will not be turned.

Figure 9:
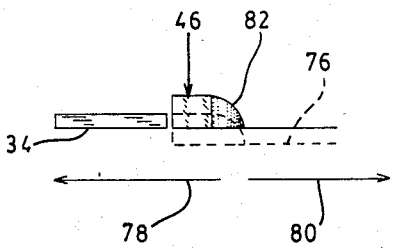
FIG. 9 is a schematic drawing illustrating the operation of the closing tabs of the present invention.

A schematic drawing of the closing tabs 34 and 46 is shown in FIG. 9. As in FIG. 8, the solid lines indicate the positions when no pressusre is applied to the top 36 of outer member 18. When pressure is applied, the tab 46 moves to the position indicated by the dashed lines 76. Rotation of the outer member 18 in the direction indicated by the arrow 78 (clockwise) brings the tab 46 on the outer member 18 into contact with the end of tab 34 on the inner member 16. This is the position to cause tightening of the closure on the bottle. Rotation in the opposite direction, as indicated by the arrow 80, causes the tab 46 to move past the tab 34 by nature of the sloped surface 82. These relative movements of the tabs 34 and 46 occur in either position of the outer member 18; up with no pressure, or down with pressure.

The present invention can be fabricated with various changes that do not change the principles of operation. Another embodiment that includes several of the types of changes that can be made is illustrated in the cross-sectional view of FIG. 10 at 14'. Components that are identical with those of the prior embodiment carry the same number designations, and those that are changed utilize the same number with a prime. As in the prior embodiment, there is an inner member 16' which has a neck portion 26 that penetrates and snaps in a central aperture 30 of an outer member 18'. This inner member is provided with internal threads 24 to engage threads of a bottle upon which the present closure is to be used. The lip portion 22' has been modified at a bottom edge to provide a radially extending flange 84. The outer member 18' has been similarly modified to provide an inwardly directed ridge 86, with the flange 84 and the ridge 86 having complimentary curved configurations such that the outer member 18' can be snapped over the inner member 16' in a manner similar to that shown in FIG. 3 of my above-referenced patent.

Figure 10:
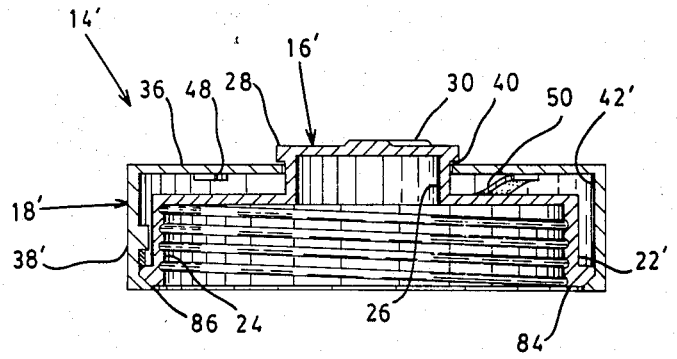
FIG. 10 is a cross-sectional view of another embodiment of the present invention as taken at 10—10 of FIGS. 11 and 12 when the components of those figures are assembled together.
Figure 11:
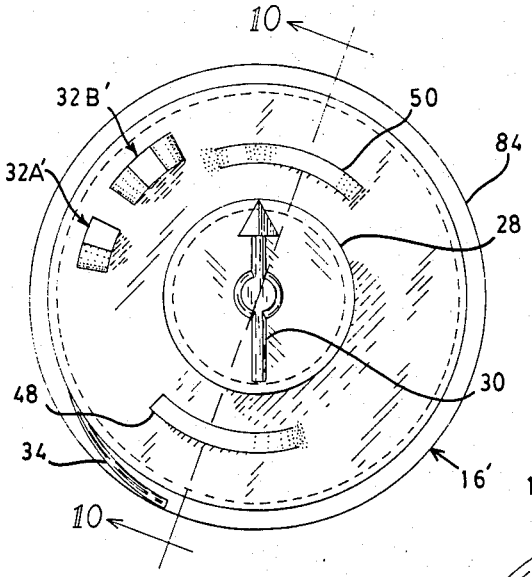
FIG. 11 is a top view of a modified inner member of the present invention showing the opening tabs positioned upon the top surface of that member.
Figure 12:
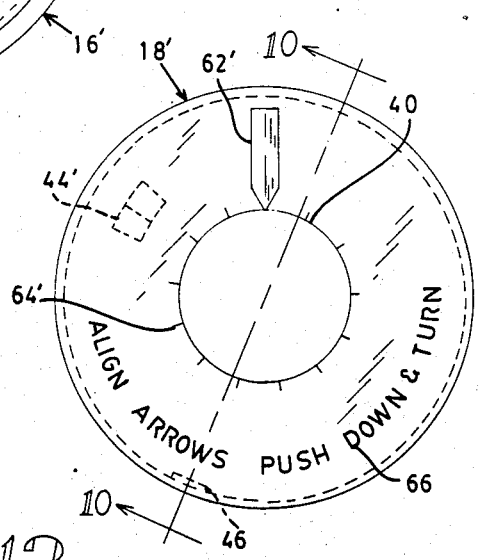
FIG. 12 is a top view of a modified outer member of the present invention showing the position of the opening tab thereon.

A further change illustrated in this embodiment can be seen by referring to FIGS. 11 and 12. It can be seen that the opening tabs 32A' and 32B' have been moved to the top surface of disk portion 20' of the inner member 16'. Correspondingly, the tab 44' is moved to the underside of the top 36' of the outer member 18' at the same radius. In these positions, the opening tabs still function in the same manner as illustrated in FIG. 8. A minor modification illustrated in these FIGS. 10 through 12 is the removal of the word "OPEN" from the arrow 62', and the removal of numbers from the positions 64'. As indicated, these are optional variations.

This second embodiment shown in FIG. 10 utilizes the same lifting tabs 48, 60 as in the prior embodiment. It will be understood that these lifting tabs could be attached to the underside of the top 36 of outer member 18' rather than to the inner member 16'. The invention is not limited to this particular type of biasing means, however. For example, an annular wave-type spring encircling the neck 26 could be used to accomplish the biasing apart of the inner member 16 (or 16') and the outer member 18 (or 18'). Such a spring would also permit the movement of the outer member 18 toward the inner member 16 whereby the opening tab 44 (or 44') will engage the tabs 32A and 32B (or 32A' and 32B'). Other variations would include the reversal of the tab components: tabs 32A and 32B on the outer member 18, and tab 44 on the inner member. The closing tabs 34 and 46 can also be reversed in position on the two components as long as the correct direction of rotation is followed.

Although the operation of the present invention has been generally discussed hereinabove, the following will provide a more complete description. With regard to the embodiment of FIGS. 1 through 9, the present invention is assembled by snapping the neck 26 of the inner member 16 through the aperture 40 in the outer member 18. Thereafter, the closure can be applied to a bottle by turning the outer member 18 in a clockwise direction. The tab 46 will bear against the end of the tab 34 causing the inner member 16 to be screwed upon the bottle threads until tight. The outer member 18, with the pressure removed, can then be turned in a counter-clockwise direction by a user until one of the numerals 64 is aligned with the arrow 30; this giving, for example, the time for the next dosage of medicine. When a dosage is to be taken, the outer member is turned until the arrow 30 and the arrow 62 are aligned. With the arrows in this position, downward pressure upon the outer member 18 causes the opening tab 44 to be interlocked between tabs 32A and 32B. With continued pressure, the outer member is turned counter-clockwise and the closure is removed from the bottle. During this rotation, the closure tab 46 slips over the tab 34. To close the bottle, the above-cited closure procedure is followed. During closure, if pressure is applied to the outer member 18, the opening tab 44 will slip over the tabs 32A and 32B.

While only two embodiments have been shown and described, it will be understood that there is no intent to limit the invention by such disclosure. Rather, it is intended to cover all modifications and all constructions falling within the spirit and scope of the present invention as defined in the appended claims and their equivalents.

I claim:

1. A closure for bottles of the type having twist-type closure provision, such closure having child-proof opening characteristics, which comprises:

an inner member for sealing such bottle, said inner member having a. a disk portion, b. a peripheral lip extending at substantially right angles from said disk portion, said lip being provided on the interior thereof with a surface to cooperate with such closure provision of such bottle, and c. a central neck portion extending from said disk portion in a direction opposite said lip, said neck portion terminating in a closed flange substantially parallel to said disk portion, said flange having a diameter greater than said neck portion;

an outer member for effecting rotation of said inner member having a. a disk portion substantially parallel with said disk portion of said inner member, said disk portion of said outer member being provided with a central opening having a diameter intermediate the diameter of said neck portion and said flange whereby said flange can be snapped through said opening to assemble such closure, and b. a peripheral lip extending at substantially right angles from said disk portion and substantially equally spaced from said lip of said inner member;

biasing means interposed between said disk portions of said outer member and said inner member for normally maintaining said disk portions separated a selected distance but permitting said disk portions to be moved toward each other upon application of pressure to said disk portion of said outer member in a direction toward said inner member disk portion;

cooperating opening tab means each carried by said inner member and said outer member whereby said opening tab means are engaged when said outer member and said inner member are properly rotationally oriented and said pressure is applied to said outer member thereby effecting counter-clockwise rotation of said inner member when said outer member is rotated in a counter-clockwise direction to effect removal of such closure from such bottle;

cooperating closing tab means each carried by said inner member and said outer member whereby said inner member is rotated in a clockwise direction when said outer member is rotated in a clockwise direction to effect tightening of such closure upon such bottle; and visable alignment indicia carried by said disk portion of said outer member, adjacent said opening, and by said flange of said inner member whereby when said indicia are aligned, said opening tab means are aligned for said engagement upon application of said pressure to said outer member.

2. The closure of claim 1 further comprising hour indicating indicia equally spaced with said alignment indicia about said opening in said disk portion of said outer member.

3. The closure of claim 2 wherein said alignment indicia on said disk portion of said outer member and on said flange of said inner member, and said hour indicating indicia around said openings, are embossed.

4. The closure of claim 1 wherein said cooperating opening tab means are carried on the interior surface of said lip of said outer member and the exterior surface of said lip of said inner member.

5. The closure of claim 1 wherein said cooperating opening tab means are carried on the top surface of said disk portion of said inner member and the bottom surface of said disk portion of said outer member.

6. The closure of claim 1 wherein said biasing means comprises at least a pair of equally spaced cantelivered springs interposed between said disk portions of said outer member and said inner member.

7. The closure of claim 4 wherein said cooperating opening tab means comprises:

a singular tab attached to said interior surface of said lip of said outer member adjacent said disk portion, said singular tab provided with a flat surface substantially perpendicular to said lip of said outer member and a sloped surface receding from said tab toward said lip and said disk portion of said outer member;

a pair of spaced apart tabs attached to said exteior surface of said lip of said inner member spaced from said disk portion of said inner member said selected distance, the spacing between said pair of tabs being substantially the size of said singular tab on said outer member, one of said pair of tabs being provided with a flat surface to cooperate with said flat surface of said singular tab when said pressure is applied to said outer member to effect counter-clockwise rotation of said inner member when said outer member is rotated counter-clockwise and thus effect removal of such closure from such bottle, and the other surfaces of said opening tabs on said inner member being sloped both toward said surface of said lip and away from said disk portion of said inner member.

8. The closure of claim 1 wherein said cooperating closing tab means comprises:

a singular tab attached to the internal surface of said lip of said outer member proximate the extremity of said lip, and having a flat surface substantially perpendicular to said internal surface of said lip of said outer member; and a cantilevered tab attached to the external surface of said lip of said inner member proximate the extremity of said lip, said cantilevered tab having a free end to contact said flat surface of said singular tab on said outer member lip and oriented such that clockwise rotation of said outer member effects a clockwise rotation of said inner member.

9. The closure of claim 1 wherein said cooperating opening tab means comprises:

a singular tab attached to the interior surface of said disk portion of said outer member at a selected radius intermediate said opening and said lip of said outer member, said singular tab provided with a flat surface substantially perpendicular to said disk portion, and a sloped surface receding from said tab toward said disk portion of said outer member; and a pair of spaced apart tabs attached to the external surface of said disk portion of said inner member, said pair of tabs being at said selected radius, the spacing between said pair of tabs being substantially the size of said singular tab on said outer member, one of said pair of tabs being provided with a flat surface to cooperate with said flat surface of said singular tab when said pressure is applied to said outer member to effect counter-clockwise rotation of said inner member when said outer member is rotated counter-clockwise and thus effect removal of such closure from such bottle, and the other surfaces of said opening tabs on said inner member being sloped toward said external surface of said disk portion of said inner member to permit free rotation of said outer member without rotation of said inner member when said pressure is removed.

10. A closure for bottles of the type having external threads to receive such closure, such closure having child-proof opening characteristics and dosage time indication, which comprises:

an inner member for sealing such bottle, said inner member having a. a disk portion, b. a peripheral lip extending at substantially right angles from said disk portion, said lip being provided on the interior thereof with threads to cooperate with such threads of such bottle, and c. a central neck portion extending from said disk portion in a direction opposite said lip, said neck portion terminating in a closed flange substantially parallel to said disk portion, said flange having a diameter greater than said neck portion;

an outer member for effecting rotation of said inner member and providing such time indication having, a. a disk portion substantially parallel with said disk portion of said inner member and being provided with a central opening having a diameter intermediate the diameters of said neck portion and said flange whereby said flange can be snapped through said opening to assemble such closure, and b. a peripheral lip extending at substantially right angles from said disk portion and substantially equally spaced from said lip of said inner member;

at least one pair of cantilevered springs interposed between said disk portions of said outer member and said inner member, and equally spaced about said opening in said outer member, for normally maintaining said disk portions separated a selected distance but permitting said disk portions to be moved toward each other;

cooperating opening tabs for effecting counter-clockwise rotation of said inner member upon counter-clockwise rotation of said outer member while applying pressure to said outer member, comprising, a. a singular opening tab attached to said interior surface of said lip of said outer member adjacent said disk portion, said singular tab provided with a flat surface substantially perpendicular to said lip of said outer member and a sloped surface receding from said tab toward said lip and said disk portion of said outer member, and b. a pair of spaced apart opening tabs attached to said exterior surface of said lip of said inner member spaced from said disk portion of said inner member said selected distance, the spacing between said pair of tabs being substantially the size of said singular opening tab on said outer member, one of said pair of opening tabs being provided with a flat surface to cooperate with said flat surface of said singular opening tab when said pressure is applied to said outer member to effect said counter-clockwise rotation of said inner member when said outer member is rotated counter-clockwise and thus effect removal of such closure from such bottle, and the other surfaces of said pair of opening tabs on said inner member being sloped both toward said surface of said lip and away from said disk portion of said inner member;

cooperating closing tabs for effecting clockwise rotation of said inner member upon clockwise rotation of said outer member, comprising, a. a singular closing tab attached to the internal surface of said lip of said outer member proximate the extremity of said lip, and having a flat surface substantially perpendicular to said internal surface of said lip of said outer member; and b. a cantilevered closing tab attached to the external surface of said lip of said inner member proximate the extremity of said lip, said cantilevered tab having a free end to contact said flat surface of said singular closing tab on said outer member lip and oriented such that clockwise rotation of said outer member effects clockwise rotation of said inner member; and wherein an exterior surface of said disk portion of said outer member at said opening and said flange of said inner member are provided with alignment indicia whereby, when aligned, said opening tabs of said inner member and said outer member are aligned such that said pressure upon said outer member engages said opening tabs.

11. The closure of claim 10 further comprising hour indicating indicia on said outer member equally spaced with said alignment indicia about said opening in said disk portion of said outer member.

12. The closure of claim 11 wherein said alignment indicia on said disk portion of said outer member and on said flange of said inner member, and said hour indicating indicia around said opening, are embossed.

13. A closure for bottles of the type having twist-type external threads to receive such closure, such closure having child-proof opening characteristics and dosage time indication, which comprises:

an inner member for sealing such bottle, said inner member having, a. a disk portion, b. a peripheral lip extending at substantially right angles from said disk portion, said lip being provided on the interior thereof with threads to cooperate with such threads of such bottle, and c. a central neck portion extending from said disk portion in a direction opposite said lip, said neck portion terminating in a closed flange substantially parallel to said disk portion, said flange having a diameter greater than said neck portion;

an outer member for effecting rotation of said inner member and providing such time indication having, a. a disk portion substantially parallel with the disk portion of said inner member, said disk portion of said outer member being provided with a central opening having a diameter intermediate the diameters of said neck portion and said flange whereby said flange can be snapped through said opening to assemble such closure, and b. a peripheral lip extending at substantially right angles from said disk portion and substantially equally spaced from said lip of said inner member;

at least one pair of cantilevered springs interposed between said disk portions of said outer member and said inner member, and equally spaced about said opening in said outer member for normally maintaining said disk portions separated a selected distance but permitting said disk portions to be moved toward each other;

cooperating opening tabs for effecting counter-clockwise rotation of said inner member upon counter-clockwise rotation of said outer member while applying pressure to said outer member, comprising, a. a singular opening tab attached to the interior surface of said disk portion of said outer member at a selected radius intermediate said opening and said lip of said outer member, said singular opening tab provided with a flat surface substantially perpendicular to said disk portion, and a sloped surface receding from said tab toward said disk portion of said outer member; and b. a pair of spaced apart opening tabs attached to the external surface of said disk portion of said inner member, said pair of opening tabs being at said selected radius, the spacing between said pair of tabs being substantially the size of said singular opening tab on said outer member, one of said pair of tabs being provided with a flat surface to cooperate with said flat surface of said singular opening tab when said pressure is applied to said outer member to effect said counter-clockwise rotation of said inner member when said outer member is rotated counter-clockwise and thus effect removal of such closure from such bottle, and the other surfaces of said pair of opening tabs on said inner member being sloped toward said external surface of said disk portion of said inner member to permit free rotation of said outer member without rotation of said inner member when said pressure is removed;

cooperating closing tabs for effecting clockwise rotation of said inner member upon clockwise rotation of said outer member, comprising a. a singular closing tab attached to the internal surface of said lip of said outer member proximate the extremity of said lip, and having a flat surface substantially perpendicular to said internal surface of said lip of said outer member; and b. a cantilevered closing tab attached to the external surface of said lip of said inner member proximate the extremity of said lip, said cantilevered tab having a free end to contact said flat surface of said singular closing tab on said outer member lip and oriented such that clockwise rotation of said outer member effects a clockwise rotation of said inner member; and wherein an exterior surface of said disk portion of said outer member at said opening and said flange of said inner member are provided with alignment indicia whereby, when aligned, said opening tabs of said inner member and said outer member are aligned such that said pressure upon said outer member engages said opening tabs.

14. The closure of claim 13 further comprising hour indicating indicia on said outer member equally spaced with said alignment indicia about said opening in said disk portion of said outer member.

15. The closure of claim 13 wherein said alignment indicia on said disk portion of said outer member and on said flange of said inner member, and said hour indicating indicia around said opening, are embossed.

* * * * *